United States Patent [19]

Norkus et al.

[11] Patent Number: 4,461,600

[45] Date of Patent: Jul. 24, 1984

[54] METHOD OF AND DEVICE FOR SOLIDIFYING ROCK IN MINE TUNNELS AND THE LIKE

[75] Inventors: Hans Norkus, Herdecke; Gerd Drespa, Dortmund-Kruckel, both of Fed. Rep. of Germany

[73] Assignee: Willich GmbH & Co., Dortmund, Fed. Rep. of Germany

[21] Appl. No.: 360,913

[22] Filed: Mar. 23, 1982

[30] Foreign Application Priority Data

Mar. 24, 1981 [DE] Fed. Rep. of Germany ..... 3111462

[51] Int. Cl.[3] ..... E21D 20/02

[52] U.S. Cl. ..... 405/260; 405/269

[58] Field of Search ..... 405/260, 261, 269; 264/36, 31

[56] References Cited

U.S. PATENT DOCUMENTS 3,204,416 9/1965 Williams ..... 405/260

3,494,134 2/1970 Jorge ..... 405/260

4,362,440 12/1982 Glaesmann et al. ..... 405/260 X

FOREIGN PATENT DOCUMENTS 259462 1/1968 Austria .

2133593 7/1973 Fed. Rep. of Germany ..... 405/260

1408366 1/1975 United Kingdom .

601425 4/1978 U.S.S.R. .

*Primary Examiner*—Dennis L. Taylor

[57] ABSTRACT

A tubular rock bolt of strong elastomeric material, inserted into a bore of a tunnel roof or a mine face, has an outlet end spaced from the remote end of the bore through which a hardenable adhesive mass is inserted under pressure by way of an inlet in the opposite bolt extremity. An obstruction inserted between the bore wall and the bolt allows only some of the adhesive mass to enter a proximal portion of the bore under considerably lower pressure, either by flowing through or past the obstruction or by exiting through one or more restricted openings in the bolt periphery.

13 Claims, 3 Drawing Figures

METHOD OF AND DEVICE FOR SOLIDIFYING ROCK IN MINE TUNNELS AND THE LIKE

FIELD OF THE INVENTION

Our present invention relates to a method of solidifying rock in mine tunnels and the like as well as to a device for carrying out this method.

BACKGROUND OF THE INVENTION

In order to shore up a roof or a wall of a mine tunnel or gallery, or to prevent the premature disintegration of a mine face, it is customary to drill bores into such a rock formation and to insert bolts or studs into these bores where they are held in position by a suitable bonding agent such as, for example, a cementitious mass known as shotcrete. A bolt thus cemented in place can also be used as an anchor for a load-supporting member, e.g. a retainer for a carriage rail or for a supply conduit.

With two-component bonding agents, such as a liquid resin and a hardener therefor, it is convenient to seal the components in a frangible cartridge which is lodged in the bore and is ruptured by a rock bolt subsequently driven into that bore; see, for example, British Pat. No. 1,408,366 and U.S. Pat. No. 4,132,080. It is also known, e.g. from U.S. Pat. No. 3,892,101, to supplement the bonding agent by a charge of solid balls or the like designed to stabilize the bolt in the bore, especially when that bore is horizontal. It has further been proposed (Austrian Pat. No. 259,462) to use as an anchor member an internally threaded tube which is completely received in the bore and has apertured wall portions surrounded by elastic rings serving as one-way valves through which a hardenable bonding substance can escape into a surrounding clearance after being injected under pressure into the tube; the entrance end of the tube, located well inside the bore, is enveloped by an inflated seal to prevent the escape of any bonding agent from that clearance. Still another proposal (USSR Pat. No. 601,425) involves the axial shifting of a bolt provided with peripheral camming surfaces for forcing the surrounding adhesive mass into firm contact with the bore wall.

OBJECTS OF THE INVENTION

The general object of our present invention is to provide an efficient method of cementing an anchor member such as a threaded bolt in a bore of a rock formation in such a manner that the bonding agent used for this purpose not only fills practically the entire bore but also penetrates into adjoining cracks of the rock for consolidating same.

A related object is to provide simple and efficient means for carrying out this method.

SUMMARY OF THE INVENTION

The rock-solidifying method according to our invention comprises, as a first step, the conventional drilling of a bore with an accessible entrance end and a closed remote end into a rock formation which might be part of the overburden of a mine tunnel but could also be a mine face, for example. We then partly insert an open-ended tubular rock bolt with peripheral clearance into the bore while leaving a space between an outlet end of the bolt and the remote bore end. Thereafter, an accessible inlet end of the bolt is connected to a source of hardenable bonding agent under high pressure which is thereby injected into the bore by way of the tubular bolt and the space left free at its remote end. By obstructing an intermediate zone of the clearance between the bolt and the bore wall, we prevent or at least throttle a return flow of the bonding agent through the bore to its entrance end.

Advantageously, in order to cement also the inlet portion of the bolt to the rock, we let part of the bonding agent enter the region of the bore entrance under reduced pressure.

Suitable flow-obstructing means in a device according to our invention may comprise a collar surrounding the bolt, this collar preferably having one or more restricted passages enabling part of the bonding agent to enter the region of the entrance end of the bore from the remote portion thereof into which the agent has been injected under high pressure. We may also form the bolt with one or more restricted wall apertures ahead of the collar or other flow-obstructing means whereby part of the bonding agent can enter the region of the entrance end directly from the interior of the bolt.

In lieu of a fixed collar permanently surrounding the bolt, we may provide the latter with one or more annular wall portions adapted to bulge outward into contact with the bore wall in response to the pressure of the bonding agent present in its interior; after part of that bonding agent has entered the bore in the aforedescribed manner so as to occupy the intervening clearance, the pressure exerted by the fluid mass in that clearance counteracts the internal pressure whereby the bulging wall portions of the bolt are partly pushed back to let some of the mass flow past toward the entrance region. In any event, the bolt advantageously consists of a high-strength elastomeric material, e.g. a silicone-rubber product known as "Silastic" or a polyurethane available under the name "Vulkolan", enabling it to follow shifts in the rock due to the mining operations carried out nearby.

BRIEF DESCRIPTION OF THE DRAWING

The above and other features of our invention will now be described in detail with reference to the accompanying drawing in which.

SPECIFIC DESCRIPTION

Figure 1:
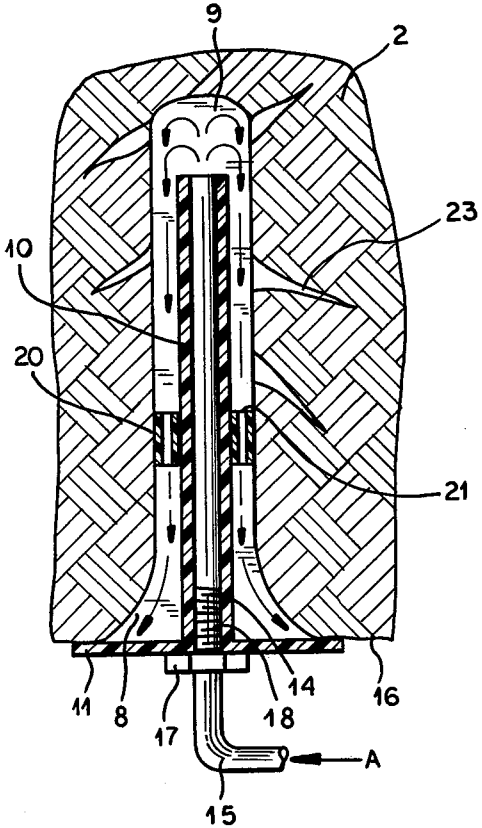

In FIG. 1 we have shown a rock formation 2, part of the roof of a mine tunnel, provided with a bore 9 having a flared lower entrance end 8. A rock bolt 10 of high-strength elastomeric material is inserted into that bore but terminates short of its closed upper end. Bolt 10 is integral with a bottom plate 11 serving to close the entrance end 8 against the outside by its contact with roof surface 16. A female screw thread 14 in the accessible lower end of bolt 10 is engaged by a complementarily threaded fitting 17 designed to couple a hose 15 to the bolt. A nonillustrated pump delivers a hardenable bonding agent via hose 15, as indicated by an arrow A, to the interior of bolt 10 and thence through the upper or outlet end of that bolt to the space at the top of bore 9 whence the fluid mass passes downward into an annular clearance separating the bore wall from the bolt. A collar 20, preferably also made of elastomeric material, has narrow passages 21 through which part of the bonding agent can pass under reduced pressure into the region of the bore entrance 8 where it accumulates above bottom plate 11 to fill the space surrounding the lower bolt portion. Some of the high-pressure mass above collar 20 is forced into cracks 23 of the surrounding rock to solidify same while firmly anchoring the bolt 10 in position.

After the injected mass has hardened, fitting 17 can be unscrewed whereupon the threaded part 14 can be engaged by, say, a hook 40 (FIG. 2) or some other load-supporting member.

Figure 2:
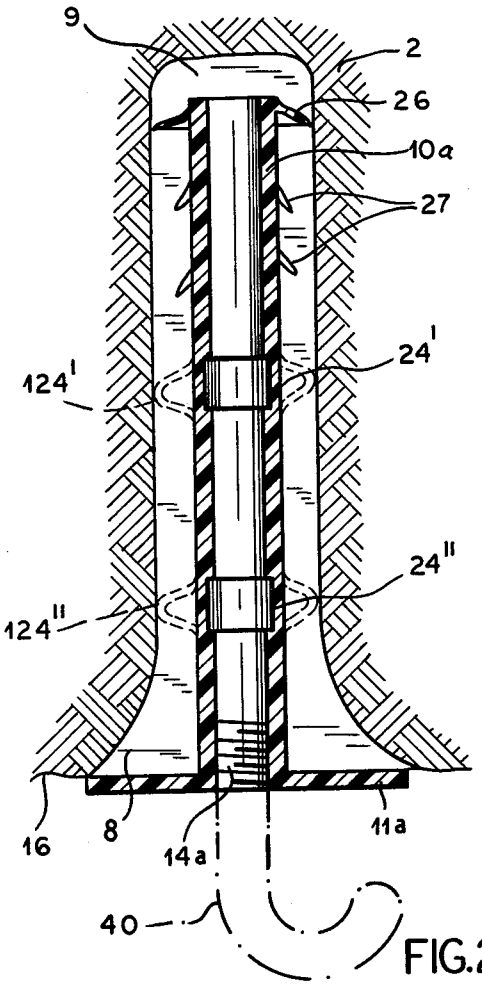

FIG. 2 shows a generally similar rock bolt 10*a* whose peripheral wall has several zones 24', 24" of reduced thickness and is also provided at its top with an elastic flange 26 acting as a yieldable seal for the space of bore 9 above the bolt. When an adhesive mass is injected into the bore 9 through the bolt 10*a* in the aforedescribed manner, its pressure causes the zones 24', 24" to bulge outward as indicated by phantom lines 124', 124". When the pressure is sufficient to overcome the resistance of flange 26, the mass passes down into the annular clearance surrounding the upper part of the bolt and is temporarily stopped by the first bulge 124'. After a sufficient pressure buildup, that bulge is forced back to let some of the mass continue into an adjacent bore portion where the flow is again temporarily obstructed by the next bulge 124". Eventually, both bulges are repressed so that the bonding agent can also occupy the entrance region 8 of the bore under considerably reduced pressure; as before, that entrance region is advantageously closed by a bottom plate 11*a* integral with the bolt 10*a* whose inlet end is again threaded as indicated at 14*a*.

FIG. 2 further shows the bolt 10*a* provided in its upper part with barbs 27 by which it is more firmly anchored in the surrounding bonding material upon the hardening thereof. Such barbs could also be provided on the bolts of other embodiments.

Figure 3:
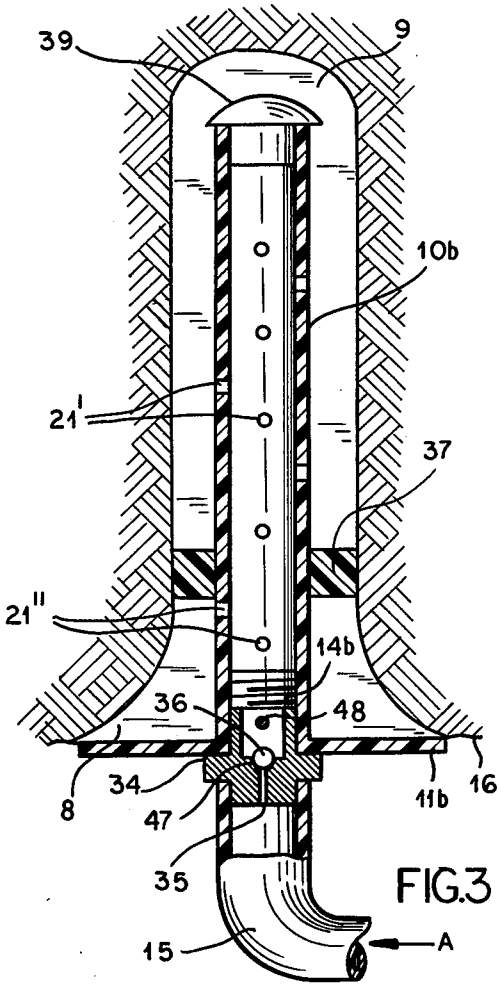
FIGS. 1, 2 and 3 are sectional views of part of a rock formation provided with respective rock bolts representing different embodiments.

Another modified bolt 10*b* according to our invention, shown in FIG. 3, has its outlet end temporarily closed by a plug 39 which lifts under the pressure of the incoming bonding material to let the same pass into the bore 9 whose lower portion is obstructed by a collar 37; in this instance the collar has no passages but some of the entering bonding material can flow through narrow holes 21', 21" of the bolt wall into the surrounding clearance both above and below the collar. The upper holes 21' could be omitted and only serve to establish bridges between the bonding material inside and outside the bolt; the lower holes 21" again allow the entrance region 8 of the bore to be filled up with low-pressure bonding agent. The combined cross-sectional area of all these holes should, of course, be so limited that the pressure necessary to unblock the upper end of the bolt is achieved in its interior. Similar holes could also be provided in the bolt 10 or 10*a* of FIG. 1 or FIG. 2.

A modified fitting 34, engaging the screw thread 14*b* of the inlet end of bolt 10*b* and resting against its bottom plate 11*b*, has a channel 35 overlain by a ball 36 which acts as a check valve designed to block the return flow of bonding fluid to the supply hose 15 after the pump has stopped operating. Ball 36, whose escape under the pressure of the incoming bonding liquid is blocked by a transverse pin 48, then rests on a frustoconical seat 47 of fitting 34. Such a check valve could, of course, also be used with the other embodiments.

Bottom plate 11, 11*a* or 11*b*, while desirable, may be omitted under some circumstances, as where the bore is horizontal rather than vertical or where its entrance end is not widened.

We claim:

1. A method of solidifying a rock formation in a mine, comprising the steps of:

drilling a bore with an accessible entrance end and a closed remote end into said rock formation;

partly inserting an open-ended tubular rock bolt with peripheral clearance into said bore while leaving a space between an outlet end of said rock bolt and the remote end of said bore;

connecting an accessible inlet end of said rock bolt to a source of hardenable bonding agent under high pressure for injecting same into the bore by way of said outlet end and said space;

providing an obstruction in an intermediate zone of said clearance for at least throttling a return flow of said bonding agent through said bore to the entrance end thereof;

sealing said entrance end against the outside by a closure member surrounding said inlet end at a location spaced from said obstruction; and allowing part of said bonding agent to enter the sealed space between said obstruction and said closure member from the interior of said rock bolt through a restricted passage and under reduced pressure.

2. A device for solidifying a rock formation in a mine, said formation having a bore with an accessible entrance end and a closed remote end, comprising an open-ended tubular rock bolt inserted with peripheral clearance into said bore, said rock bolt having an outlet end spaced from said remote end and an inlet end opposite said outlet end provided with coupling means for enabling a connection thereof to a source of hardenable bonding agent under high pressure, said rock bolt being provided at an intermediate location between said inlet and outlet ends with flow-obstructing means for at least throttling a return flow of said bonding agent through said bore to the entrance end thereof and being further provided with an abutment plate closing said entrance end at a location separated from said flow-obstructing means by a sealed space accessible through a restricted passage from the interior of said rock bolt whereby some of the bonding agent introduced into said rock bolt by said source can enter said sealed space under a reduced pressure.

3. A device as defined claim 2 wherein said flow-obstructing means comprises a collar surrounding said rock bolt.

4. A device as defined in claim 3 wherein said collar is provided with said restricted passage.

5. A device as defined in claim 2 wherein said flow-obstructing means comprises at least one weakened annular wall portion of said rock bolt adapted to bulge outward into contact with the bore wall in response to internal pressure of bonding agent filling the interior of said rock bolt but with sufficient inward yieldability to form said restricted passage in response to a countervailing pressure from said return flow.

6. A device as defined in claim 2 or 3 wherein said rock bolt has at least one wall aperture ahead of said flow-obstructing means forming said restricted passage.

7. A device as defined in claim 2, 3, 4 or 5 wherein said rock bolt is provided with a cap initially blocking said outlet end, said cap being displaceable by pressure of said bonding agent accumulating inside said rock bolt for unblocking the outflow thereof.

8. A device as defined in claim 5 wherein said rock bolt is further provided with a flexible peripheral flange near said outlet end initially contacting the wall of said bore for building up said internal pressure.

9. A device as defined in claim 2, 3, 4 or 5 wherein said rock bolt is provided with barbs at least in the vicinity of said outlet end.

10. A device as defined in claim 2, 3, 4 or 5 wherein said coupling means includes a check valve preventing a return of bonding agent from the interior of said rock bolt to said source.

11. A device as defined in claim 2, 3, 4 or 5 wherein said rock bolt is provided at said inlet end with a threaded extremity accommodating a load-supporting member upon removal of said coupling means.

12. A device as defined in claim 2, 3, 4 or 5 wherein said rock bolt consists of high-strength elastomeric material.

13. A method as defined in claim 1 wherein said obstruction is created by providing the rock bolt with at least one weakened annular wall portion adapted to bulge outward toward the bore wall in response to internal pressure of bonding agent injected into the interior of said rock bolt, and enabling said internal pressure to build up by providing the outlet end of the rock bolt with a flexible peripheral flange placed initially in contact with the bore wall to impede the flow of bonding agent through said clearance toward the region of said weakened wall portion until contact between the bulging wall portion and the bore wall forces the injected bonding agent to clear a path around said peripheral flange, thereby setting up a return flow partly repressing the bulging wall portion to establish said restricted passage.

* * * * *